US009612088B2

(12) United States Patent
Theriault

(10) Patent No.: US 9,612,088 B2
(45) Date of Patent: Apr. 4, 2017

(54) SHOOTING SYSTEM WITH AIM ASSIST

(71) Applicant: Raytheon Company, Waltham, MA (US)

(72) Inventor: Philip Theriault, Waltham, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/271,230

(22) Filed: May 6, 2014

(65) Prior Publication Data

US 2015/0323286 A1 Nov. 12, 2015

(51) Int. Cl.

| | |
|---|---|
| ***F41G 3/12*** | (2006.01) |
| ***F41G 3/00*** | (2006.01) |
| ***F42B 12/38*** | (2006.01) |
| ***F41C 27/22*** | (2006.01) |
| *F41G 1/00* | (2006.01) |
| *F41G 3/06* | (2006.01) |

(Continued)

(52) U.S. Cl.

CPC ..... *F41G 3/12* (2013.01); *F41C 27/22* (2013.01); *F41G 3/00* (2013.01); *F42B 12/38* (2013.01); *F41G 1/00* (2013.01); *F41G 3/06* (2013.01); *F41G 3/08* (2013.01); *F41G 3/142* (2013.01)

(58) Field of Classification Search

CPC ... Y10T 24/2128; Y10T 24/7128; F41G 3/08; F41G 3/10; F41G 3/142; F41G 3/12; F41G 3/00; F41G 1/00; F41G 3/06; F41C 27/22; F42B 12/38

USPC ..... 235/404; 42/111, 115; 89/127, 132, 133, 89/114.3, 14.3, 37.08, 37.09, 41.02, 89/41.01, 41.14, 41.15, 41.17, 41.22, 202, 89/203, 204, 205, 41.09

See application file for complete search history.

(56) References Cited

U.S. PATENT DOCUMENTS

| | | | |
|---|---|---|---|
| 2,705,792 | A | 4/1955 | Harris, Jr. |
| 4,823,674 | A | 4/1989 | Nilsson |

(Continued)

FOREIGN PATENT DOCUMENTS

| | | | |
|---|---|---|---|
| EP | 0 898 144 | A2 | 2/1999 |
| EP | 0898144 | B1 | 11/2005 |

OTHER PUBLICATIONS

Army Technology; Lockheed to Develop Advanced Rifle Scope; http://www.army-technology.com/news.news86306.html ; May 27, 2010; 1 page; army-technology.com.

(Continued)

*Primary Examiner* — John D Cooper

(57) ABSTRACT

A shooting system for improving the accuracy of a shot at a target as fired from a hand-held firearm. The shooting system can comprise a targeting system operable with the firearm, the targeting system operable with one or more sensors to obtain targeting information pertaining to a target. The targeting system can further determine an optimal aiming vector and an aim deviation of the optimal aiming vector from an actual aiming vector based on the targeting information. The shooting system can further comprise an aim assist system in communication with the targeting system that functions to receive information corresponding to the aim deviation, the aim assist system comprising a momentum transfer system supported by the firearm and operable to induce a motion within the firearm to manipulate the actual aiming vector of the firearm and to correct for the aim deviation.

9 Claims, 6 Drawing Sheets

(51) Int. Cl.

| | |
|---|---|
| *F41G 3/08* | (2006.01) |
| *F41G 3/14* | (2006.01) |

(56) References Cited

U.S. PATENT DOCUMENTS

| | | | | |
|---|---|---|---|---|
| 5,827,992 | A | 10/1998 | Harris et al. | |
| 5,834,677 | A | 11/1998 | Muller | |
| 5,974,940 | A | 11/1999 | Madni et al. | |
| 6,234,045 | B1 * | 5/2001 | Kaiser | F16F 7/1005 74/572.2 |
| 7,549,367 | B2 | 6/2009 | Hill | |
| 7,802,394 | B1 | 9/2010 | Bartoli | |
| 7,926,220 | B2 | 4/2011 | Holmberg | |
| 8,196,828 | B2 | 6/2012 | Kelly | |
| 8,543,368 | B1 | 9/2013 | Sznajder et al. | |
| 8,601,736 | B2 | 12/2013 | Andersson | |
| 8,651,381 | B2 * | 2/2014 | Rudich | F41G 11/001 235/404 |
| 2011/0315767 | A1 * | 12/2011 | Lowrance | F41G 3/02 235/404 |
| 2012/0042559 | A1 * | 2/2012 | Bockmon | F41A 27/30 42/111 |
| 2012/0097741 | A1 * | 4/2012 | Karcher | F41G 1/38 235/404 |
| 2012/0255213 | A1 | 10/2012 | Panos | |

OTHER PUBLICATIONS

Brosseau et al.; The Inertial Reticle Technology (IRT) Applied to an M16A2 Rifle Firing From a Fast Attach Vehicle; Army Research Laboratory report; Apr. 2000; 54 pages; Army Research Laboratory.

Bushnell; Bushnell Laser Rangefinder Yardage Pro Sport 450; Owner's Manual; Upon knowledge and belief prior to Jan. 2013; 48 pages; Bushnell Outdoor Products.

Bushnell; Bushnell Yardage Pro Riflescope; Owner's Manual; Upon knowledge and belief prior to Jan. 2013; 86 pages; Bushnell Outdoor Products.

Hambling; Army Tests Flying Robo-Sniper; Wired; Apr. 21, 2009; 13 pages; WIRED.com.

Hambling: UAV Helicopter Brings Finesse to Airstrikes; Popular Mechanics; Apr. 14, 2009; 3 pages; Hearst Communications, Inc.

Kestrel Meters; Kestrel Shooters Weather Meter with Applied Ballistics; KestrelMeters.com; Mar. 12, 2013; 2 pages; KestrelMeters.com.

Lockheed Martin; DARPA Awards Lockheed Martin $7 Million Contract to Produce Laser Enhanced Sniper Systems; http://www.lockheedmartin.com/us/news/press-release/2010/december/DARPAAwardsLockheedMartin.html ;Dec. 14, 2010; 1 page; Lockheed Martin Corporation.

Lockheed Martin; Ready, Aim, Fire; https://web.archive.org/web/20130104020055/http://www:lockheedmartin.com/us/mst/features/110922-ready-aim-fire.html ; archived online Jan. 4, 2013; 2 pages; Lockheed Martin Corporation.

McNamara; What's the Difference Between Voice Coil Actuators and Solenoids?; Electronic Design; Jun. 19, 2012; 3 pages; http://electronicdesign.com/print/components/what-s-difference-between-voice-coil-actuators-and-solenoids.

PR Newswire; DARPA Awards Lockheed Martin $3.9m Contract to Develop Advanced Rifle Scope for Soldiers; https://webarchive.org/web/20100530094203/http:/www.prnewswire.com/news-releases/darpa-awards-lockheed-martin-39m-contract-todevelop-advanced-rifie-scope-for-soldiers-94916109.html ; archived online May 30, 2010; 1 page PR Newswire Association LLC.

Space Dynamics Laboratory; ARSS—Autonomous Rotocraft Sniper System; https://web.archive.org/web/20090419173737/http://www.sdl.usu.edu/programs/arss ; archived online Apr. 19, 2019; 1 page; Space Dynamics Laboratory—Utah State University Research Foundation.

SITIS Archives; ASP Motion Base or Stabilized Mounts; http://www.dodsbir.net/sitis/archives_display_topic.asp?Bookmark=42650 ; downloaded from internet Jan. 27, 2013; 3 pages; SITIS.

Tracking Point; Precision Guided Firearms; https://web.archive.org/web/20130127223045/http://tracking-point.com/precision-guided-firearms ; Archived online Jan. 27, 2013; 3 pages; TrackingPoint.

Tracking Point; Owner's Manual; https://web.archive.org/web/20130813201613/http://tracking-point.com/sites/default/files/Tracking-Point-Owners-Manual.pdf; Archive online Aug. 13, 2013; 36 pages; TrackingPoint.

Tracking Point; What is PGF?; https://web.archive.org/web/20130117054253/http://tracking-point.com/what-is-a-pgf ; Archived online Jan. 17, 2013; 5 pages; TrackingPoint.

Varshneya; Adaptive Execution Office—One Shot XG; https://web.archive.org/web/20131126073540/http://www.darpa.mil/Our_Work/AEO/Programs/One_Shot_XG.aspx ; archived online Nov. 26, 2013; 2 pages; DARPA.

Wikipedia; Autonomous Rotorcraft Sniper System; https://web.archive.org/web/20130719061353/http://en.wikipedia.org/wiki/Autonomous_Rotorcraft_Sniper_System ; Jul. 19, 2013; 3 pages.

* cited by examiner

SHOOTING SYSTEM WITH AIM ASSIST

BACKGROUND

Aiming and accurately firing a handheld firearm has long been a worthwhile pursuit and has been a point of pride and a skill of particular importance in many fields of endeavor. Whether military or for the common sportsman, a marksman who can hit a desired target has been recognized as particularly useful for a wide variety of possible objectives.

There are several factors which present difficulties for a marksman when trying to fire at, and hit, particular targets. Many factors which present difficulty are derived internally from the marksman's own person. Some of these factors include the tendency to flinch when pulling the trigger, the correction and compensation for the force required to pull the trigger, the degree of steadiness of the marksman's breathing, etc. These types of factors can often be overcome with practice and particular techniques which can minimize the effects of these factors or train a marksman to eliminate them.

Other personal factors can include the fact that the human body is incapable of achieving absolute stillness. Tremors, swaying, and other such motion cannot be completely eliminated regardless of training. In order to overcome such deficiencies electronic stabilization systems have been developed which help to reduce the effect such movements have on the firearm during aiming and prior to firing. These systems can include gyroscopic-based systems that apply a continuous corrective moment to the firearm and minimize tremors and other micro-movements, which micro-movements can be applied to the firearm by the marksman.

Besides the various internal targeting factors, there are also many external factors which can come into play while aiming and shooting a firearm, as well as that may affect the bullet's trajectory after leaving the barrel of the firearm. These factors can include various environmental factors, such as barometric pressure, altitude, wind speed, wind direction, angle up/down of the target with respect to the firearm, etc. These factors are well known to affect bullet trajectory and various systems have been developed that provide models of bullet trajectory based on these various factors.

Other external targeting factors can include characteristics of the target itself. For instance, the target can be stationary (e.g., as is common in target shooting situations), or the target can be moving (e.g., as is common in hunting and military situations). Obviously, stationary targets are much easier to hit than moving targets. However, some targets can be moving, and even capable of erratic or high speed motion, and therefore can be ever-increasingly difficult to hit. In addition, the target can also be extremely close or extremely far away. Other factors can include target size or acceptable targeting areas of a larger whole.

BRIEF DESCRIPTION OF THE DRAWINGS

The present invention will become more fully apparent from the following description and appended claims, taken in conjunction with the accompanying drawings. It should be understood that these drawings merely depict exemplary embodiments of the present invention, they are, therefore, not to be considered limiting of its scope. It will be readily appreciated that the components of the present invention, as generally described and illustrated in the figures herein, can be arranged and designed in a wide variety of different configurations. Nonetheless, the invention will be described and explained with additional specificity and detail through the use of the accompanying drawings in which:

DETAILED DESCRIPTION

Figure 1:
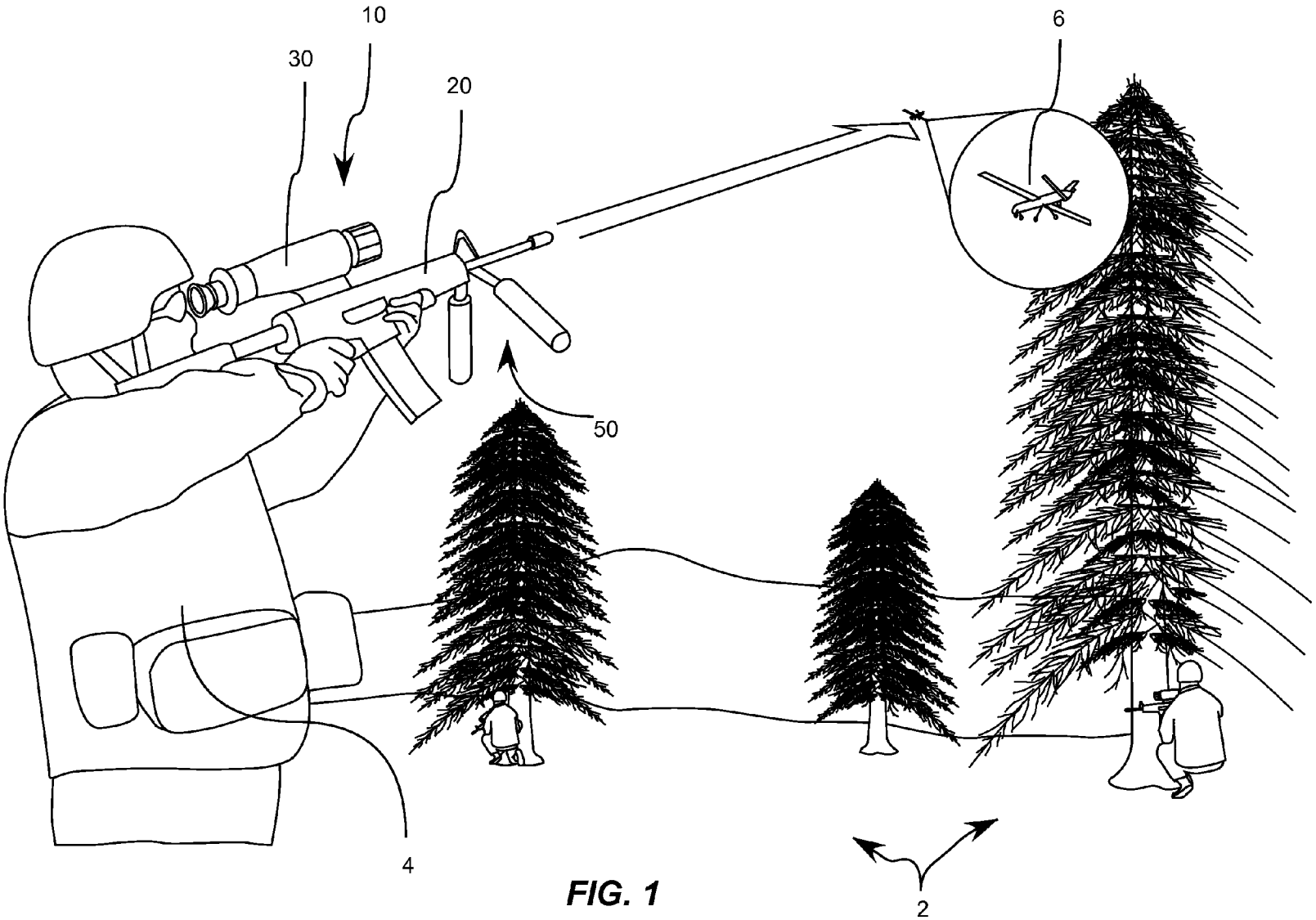
FIG. 1 illustrates an example implementation showing an individual as part of a group holding a rifle-type shooting system in accordance with a an exemplary embodiment of the present invention.

An initial overview of the technology's various embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although the present invention can apply to a variety of shooting situations, one of particular note is a shooting scenario in which one or more soldiers are trying to neutralize an Unmanned Aerial Vehicle (or UAV). Although discussed below, this shooting situation or scenario is not intended to be limiting in any way, but is merely exemplary of one type of shooting scenario.

As technology advances, enemies begin to adopt such technology in order to gain an advantage. One such technology is Unmanned Aerial Vehicles, hereinafter referred to UAV's. These UAV's can now be easily equipped with digital cameras or other surveillance equipment which allow for remote operation in order to gather information and relay such information back to the enemy without ever compromising the lives of the operators. Such UAVs are inexpensive and easy to build and can be deployed relatively quickly.

As can be readily understood, soldiers, when they see such surveillance UAVs, want to neutralize them (e.g., shoot them down or disable them) so the UAVs can no longer be used to relay information regarding location and movements back to an enemy. By neutralizing the UAV, soldiers can often move to a safer location or choose a different course of attack before a new UAV can be deployed to the area. Often such repositioning can be achieved even before the enemy can react, i.e. deploy an intercepting force. Neutralizing the UAV typically blinds the enemy for a period of time in which a tactical advantage can be gained. It is therefore well understood that neutralizing UAVs is often desirable.

Current systems for neutralizing UAV's typically involve firing a small missile, i.e. something similar to a stinger missile, with targeting and course correction capabilities to deliver some sort of explosive ordinance to the UAV's location and thereby destroy the UAV. Such missiles are burdensome to carry and are typically expensive when compared to the typically low cost of a primitive level surveillance UAV. These primitive level surveillance UAVs typically only require a very small remote controlled airplane or some sort of aerial vehicle, a camera located thereon, and a communication relay or method to return recorded imagery to the user. Thus, a new primitive UAV can be deployed relatively inexpensively, whereas a new missile for removing the UAV may become prohibitively expensive if necessary for multiple iterations.

Soldiers often encounter UAVs being utilized for surveillance, reconnaissance, and remote operations wherein many of these UAVs can be either remote controlled or autonomous. Additionally, UAV's can now carry warheads or other remotely operated weapons systems which can directly threaten soldiers. UAV's can vary in design and functionality. However, one type of UAV that can present particular difficulty are remote controlled or autonomous UAVs having fixed wings, i.e. airplanes. These fixed wing UAV's present particular difficulty because they are often small and might not even present enough targeting information for a such a missile to lock on to for the purpose of targeting and destroying them. Such missiles may be small, but as any soldier will attest, carrying a whole new piece of heavy equipment for sporadic eventualities wherein a UAV may be encountered can be burdensome. Due to environmental conditions and other factors, soldiers typically want to carry as little weight as possible to allow for more of such essentials as food, water and ammunition.

As a result of the drawbacks of small missiles that can be carried by individual soldiers, many soldiers choose to fire at UAV's with their standard issue rifles. However, UAV's provide a very challenging target, and it is extremely difficult, if not impossible, to fire an effective shot using such a rifle. Even soldiers firing fully automatic weapons experience extreme difficulty walking the line of fire into the UAV as it passes within range. This difficulty is a result of multiple factors including the fact that it is hard to anticipate the motion of the UAV, it is also difficult to judge the trajectory of the bullet from the rifle with the sky as a backdrop. As such, it is difficult to discern where the rifle truly needs to be pointed. Even the best marksmen are typically unable to target and actually hit a UAV in flight. This is true even in the best flight scenarios, such as when the UAV is close or when it is heading directly towards or away from a marksman in a manner that it is easier to track with the rifle's telescopic sight (scope).

Figure 2:
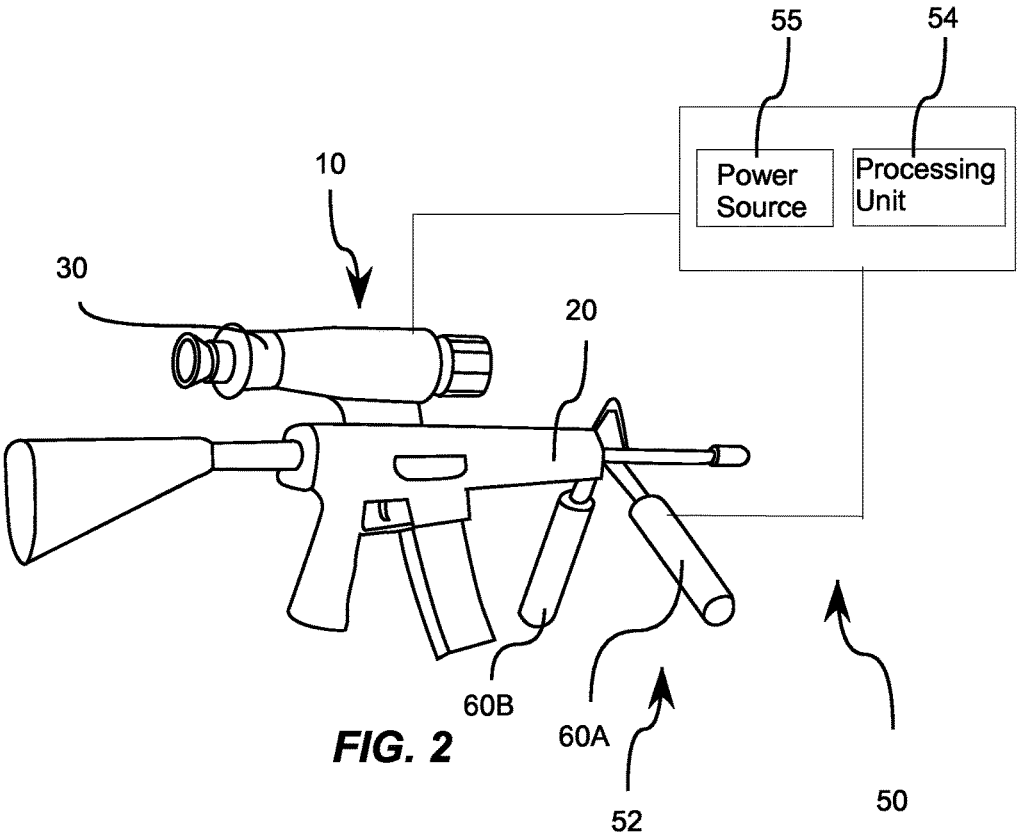
FIG. 2 illustrates a side isometric view of the shooting system of FIG. 1.
Figure 3:
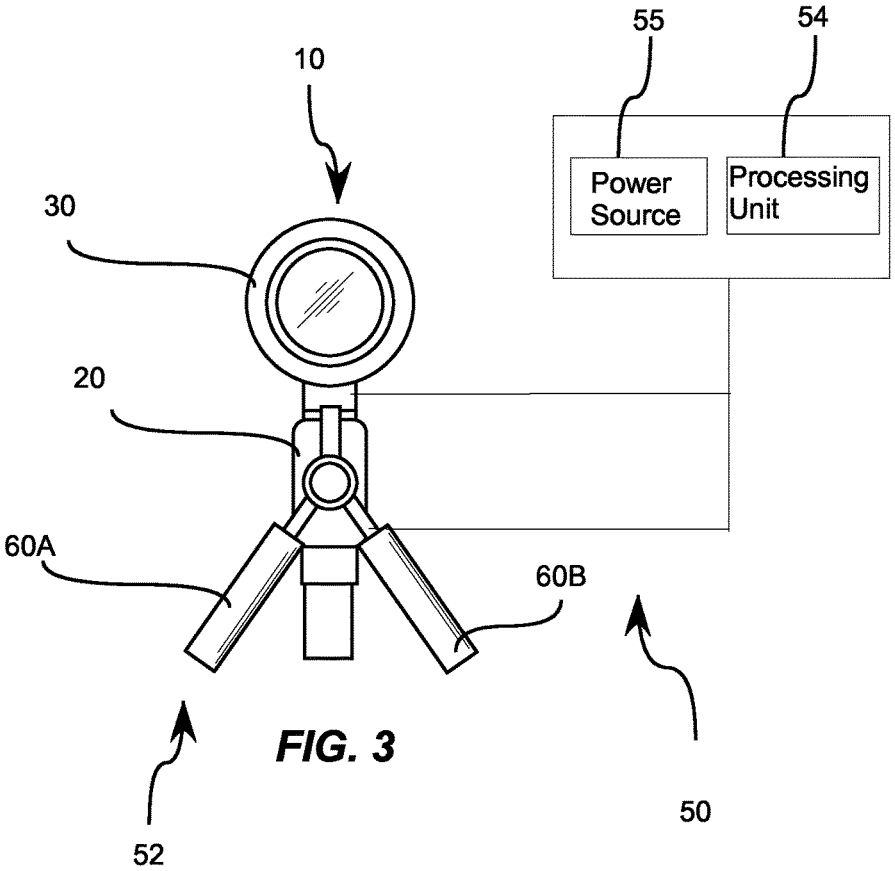
FIG. 3 illustrates a front view of the shooting system of FIG. 1.

In reference to FIGS. 1-3, illustrated is a shooting system 10 comprising a hand-held firearm 20 (e.g., pistol, rifle, carbine, machine gun, submachine gun, personal defense weapon, or many other small arms designed to be carried by an individual, and more particularly, a single individual), a targeting system 30, and an aim assist system 50 operable with the firearm 20 and the targeting system 30. The shooting system 10 can be carried by an individual 4 (e.g., a soldier shown as part of a group or unit 2), as depicted in FIG. 1. The shooting system 10 may be used for shooting at a target 6 (in this case a UAV as one non-limiting example, wherein the shooting system 10 is configured to remove or neutralize the UAV 6). Although a UAV type target is discussed primarily herein, those skilled in the art will recognize that the shooting system 10 can be utilized with a number of different types of targets. In addition, those skilled in the art will recognize that the shooting system 10 can be incorporated into other non-military type weapons for use in a variety of applications, such as sport or hunting scenarios. It should further be appreciated that one individual, or a plurality of individuals within a group can be armed with a shooting system 10.

In one exemplary embodiment, the targeting system 30 can comprise a lens and camera or other imager affixed or mounted directly to the firearm 20. In other embodiments, the targeting system 30 can comprise a telescope and camera or other imager being operated by a spotter, separate from the shooter (for example for long range targets). In each of these embodiments, the targeting system 30 is intended and configured to be operable and in communication with the aim assist system 50. However, as discussed in more detail below, certain advantages may be realized by directly affixing the targeting system 30 to the firearm 20 with which it operates.

In particular, the targeting system 30 can comprise a sighting device, such as an optical or other type of imaging telescopic sight or scope, an electronic viewfinder, etc. capable of allowing the shooter to view the target and to provide enhancement of the target and/or information useful to the shooter. The targeting system 30 can further comprise a variety of sensors (not shown). The sensors can sense and convey various types of information about the shooter's environment, conditions within the environment, and information about the intended target, such as information about the location and motion characteristics of the target. Although not discussed in detail herein, examples of such sensors include, but are not limited to humidity sensors, barometric pressure sensors, wind speed sensors, tilt and angle sensors, temperature sensors, elevation sensors, geographic latitude sensors, range finders, etc. Indeed, it is contemplated that the targeting system 30 may be equipped with any type of sensor capable of detecting a condition about or within the shooting environment, including those recognized to affect bullet trajectory or provide valuable targeting information. The system can be capable of viewing and storing information regarding the trajectory of a visible (red, blue or green) tracer shot. As discussed in more detail below, the targeting system 30 can further be equipped with an infrared camera capable of viewing and storing information regarding the trajectory of an infrared tracer shot.

The targeting system 30 can utilize the variety of sensors, as discussed above, to collect, process and convey information which can assist the shooter, such as information pertaining to conditions that can potentially affect the trajectory of any bullets fired from the firearm. A shooter using the shooting system 10 can look through the sighting device of the targeting system 30 and see a general area downrange of the firearm 20. The user can acquire a target within the sighting device and the user can indicate to the targeting system that a certain object seen within the sighting device is the desired target to shoot at. In the case of the present shooting system 10, the target will be discussed herein as a UAV 6 in flight. However, as discussed above, those skilled in the art will appreciate that such a target could be any particular object, either stationary or moving, airborne or land based.

Upon the shooter indicating the intended target to the targeting system 30, the targeting system 30 can use the information obtained from one or more of the various sensors discussed above to determine location and motion characteristics of the target, such as range, speed, elevation, etc. This information can be provided to the targeting system 30 and utilized to predict where the target will be in the time it would take a bullet fired from the firearm to reach the target. As such, information about the firearm, the ballistics being used, etc. can also be known and stored within the targeting system 30.

After the targeting system 30 calculates a location where the target is likely to be by the time a bullet fired at the target reaches the target's location, the targeting system 30 can then calculate where the firearm 20 should be repointed from an actual aiming point in order to make the trajectory of the target intercept with a ballistic arc of a bullet fired from the firearm 20. The point at which the firearm 20 is to be pointed in order for a bullet fired therefrom to hit the target is hereinafter referred to as the optimal aiming vector or alternatively the optimal aiming point. The optimal aiming vector and the characteristics of the ballistic arc can be calculated by the targeting system 30 based on the current actual aiming vector, principles of ballistics, wherein factors known to affect the bullet's trajectory, including temperature, pressure, elevation, humidity, ammunition type, firearm type, angle of the shot, powder type, powder load, etc., can be determined and used to convey the optimal aiming point to the shooter.

The targeting system 30 can further provide an indication of the optimal aiming point, such as a visible indicator within the sighting device. Therefore, the targeting system 30 can further comprise indicia indicative of the optimal aiming vector/point (as well as the actual aiming vector/point). Such indicia can include, but is not limited to, a visible indicator or display configured or caused to appear within the sighting device (e.g., a light, an arrow superimposed on an telescope image, a video graphic, etc.). The shooter, upon display of the optimal aiming point in the sighting device, can then attempt to track and acquire the optimal aiming point which point is different from the actual aiming point or aiming vector of the firearm 20. This can be done, for example, with crosshairs within a scope type sighting device. Ideally, once the actual and optimal aiming points match each other (i.e., are aligned or coincident with one another), or are within a predetermined range or degree of one another, the firearm can be fired with greater accuracy.

The difference between the actual aiming vector and the optimal aiming vector can be referred to herein as the aim deviation. When the actual and optimal aiming vectors are aligned (i.e., are coincident), or when the actual aiming vector converges with the optimal aiming vector so that the optimal aiming vector becomes the actual aiming vector, it can be said that the aim deviation is corrected. Correction of the aim deviation will signify to the shooter the highest accuracy shot potential and the appropriate time to fire the firearm at the target. Indeed, it is this situation that will provide the shooter with the most accurate shot at the target.

It should be appreciated that acquiring and tracking the optimal aiming point and trying to align the actual and optimal aiming points can prove particularly difficult, particularly with respect to a moving target, or a target that is strafing the user or shooter from a long distance, or when the target is moving at a particularly high speed or changing speeds and/or course.

It should also be appreciated that additional indicia may be provided to the shooter, such as a directional arrow indicating the direction the firearm needs to be moved in order to align the actual aiming vector with the optimal aiming vector. Further, other indicia, as would be recognized by one of ordinary skill in the art, may be provided within the viewfinder in order to provide additional useful information to the shooter.

In order to further assist the shooter, the shooting system 10 can further comprise an aim assist system 50 in electrical communication with the targeting system 30 to receive an aim deviation, or more specifically information pertaining to an aim deviation, as calculated by the targeting system 30, and to determine and apply one or more movements to the firearm sufficient to manipulate or otherwise displace or reorient the barrel or muzzle of the firearm and thereby manipulate the actual aiming vector of the firearm to correct for the aim deviation. The aim assist system 50 can comprise a processing unit 54 configured to determine at least one of a direction, magnitude, and duration of the movement(s) to be applied to the firearm, such as to determine a distance the barrel of the firearm must be displaced or reoriented, in order to eliminate the aim deviation. This determination may be based on at least one of the current actual aiming vector/point, the aim deviation, any additional targeting information, tracer shot information, and one or more correction factors.

The aim assist system 50 and the targeting system 30 can be powered by a local power source, meaning that the power source 55 is portable with the firearm and operable with the aim assist system 50 and the targeting system 30. The power source can be supported about the firearm, the shooter, can be located within or about the targeting system, can be located within or about the aim assist system 50, or a combination of any of these. The power source can comprise one or more batteries, or other type of portable power source (e.g., solar) as known in the art. As the aim assist system 50 is not in support of any part of the firearm, as discussed herein, much less power is needed to operate the aim assist system 50 than prior systems that are in support of one or more components of the firearm. In addition, power can be minimized as the motions within the aim assist system 50 are small, namely those contained within the system, and limited in their duration.

The aim assist system 50 can also comprise a momentum transfer system 52, which can be configured to apply or induce therein a one or more dimensional motion to the firearm 20 as determined by the processing unit 54 in order to displace or reorient the barrel of the firearm (i.e., manipulate the actual aiming vector) and to eliminate or correct for the aim deviation. The momentum transfer system 52 can be operable with the power source 50 and configured to generate motions and reactionary momentum movements capable of providing physical displacement and orientation change of the firearm. Stated differently, the momentum transfer system 52 can be configured to provide or generate a proportional momentum transfer to the firearm. This can be accomplished in a variety of ways, as discussed more fully below.

The momentum transfer system 52 can be fully supported by the handheld firearm. Another way of stating this is that the weight of no part or component of the firearm is supported by the momentum transfer system 52. Rather, the firearm can be picked up and manipulated by a shooter in the same way any handheld firearm would, the only difference being the firearm having coupled thereto the momentum transfer system 52. This provides distinct advantages over prior aim assist systems that operate to support the firearm (e.g., a gun turret), wherein the firearm is caused to push against the support upon activation of the aim assist feature, and where no functional or perceived momentum transfer takes place. For instance, the weight of the firearm can be kept to a manageable level as there is no complex mechanism operated by heavy motors. Indeed, and comparatively speaking, the aim assist of the present invention provides a very small increase in mass above that of just the firearm, bipod and optical sight. This also helps to reduce the amount of power needed to actuate the aim assist system; for example, small batteries may be used. In addition, portability is maintained (i.e., the shooter can easily carry the firearm) with little to no additional effort expended.

Furthermore, the momentum transfer system 52 is intended to comprise a contained or closed or substantially closed system. Essentially, this means that the momentum transfer system 52 is operable to provide a proportional momentum transfer to the firearm, where momentum between the firearm and a component of the momentum transfer system 52 (e.g., the moveable mass) is conserved with only the shooter's normal support and use being present (e.g., no object in support of the gun (other than the shooter) is needed to both support the firearm and provide a counter mass against which the firearm is caused to push). All momentum transfer operations occur within the components of the firearm and the momentum transfer system 52, the momentum transfer being applied to the firearm as the firearm is physically coupled to the momentum transfer system 52. For example, the shooter holding the rifle does not have to rest against a tree, the ground or a wall to provide the system a large mass to react against (push against). The shooter experiences a normal firearm with an optical sight and a bipod. When the shooter enables the aim assist system, the shooter experiences an improved accuracy capability. In many embodiments, a rifle equipped with an aim assist system is no heavier than a rifle with a bipod chosen for maximum accuracy and a night vision telescopic sight, for example.

The momentum transfer system 52 can comprise a transfer device physically coupled to the firearm, such as about the barrel of the firearm. The transfer device can house or enclose and support a moveable mass, wherein the motion within the firearm is induced by movement of the mass to generate a proportional momentum transfer to the firearm through the transfer device.

In one exemplary embodiment, the momentum transfer system 52 can comprise one or more motion applicators capable of translating small masses relatively large distances in order to move the larger, heavier rifle a small distance in the opposite direction. In one embodiment, the motion applicators can comprise one or more, for example, a series of, movable weights or masses and a supporting structure or transfer device secured to the firearm, such that the movable masses are moveable relative to the firearm 20. The motion applicators with the movable masses can operate to induce a reactionary momentum transfer within the firearm 20 sufficient to cause the firearm 20 to move or swing closer to the intended optimal aiming point while being held (and aimed) by the shooter, and more specifically to cause the firearm to move in a manner sufficient to manipulate the actual aiming vector of the firearm 20 to correct for the aim deviation. The aim assist system can move the firearm in a manner consistent with the shooter's intentions rather than acting against the shooter. In many cases, the aim assist system will assist the shooter in aligning the actual aiming vector with the intended target by moving the firearm in the direction intended by the shooter. The motion applied to or induced within the firearm can be generated by displacing (e.g., translating or otherwise moving) the masses relative to the firearm. When the masses are moved in one direction, the firearm swings in the opposite direction, in a ratio inversely proportional with their respective masses, e.g., the small mass moves a relatively large distance and the heavy firearm moves a small distance. Indeed, by moving the one or more masses with respect to the firearm 20, a reactionary motion or momentum transfer can be generated to cause a corresponding motion in the firearm. This momentum transfer can be applied to the firearm 20 through the motion applicator to effectuate movement of the firearm 20 and manipulation of the actual aiming vector in order to correct for the aim deviation. As the transfer device containing the masses is secured to the firearm, movement of the one or more masses contained within the transfer device will naturally generate opposite (but smaller) motions, one of which (or a component thereof) will provide the reactionary motion that acts upon the firearm. The aim assist system 50, and particularly the momentum transfer system 52, can be configured such that the reactionary motion is either strategically applied to the firearm 20, or is strategically generated, or both. As such, it is contemplated that the momentum transfer system 52 can comprise a number of different configurations and designs.

One way of explaining the operability of the momentum transfer system is with the conservation of momentum, with regard to displacement of various masses. For purposes of illustration, the firearm is a relatively heavy mass and can weigh upwards of 10-20 lbs. If the moveable mass is caused to move relative to the firearm in a transverse direction, displacement of the mass some distance will cause a relative displacement or motion of the firearm in a direction opposite from the direction the mass is moved. First, the mass is accelerated (velocity is changed) by a period of force applied to the mass by the motion actuator. The period of force on the mass is matched by an opposite period of force on the transfer device. The period of force on the transfer device as mounted to the firearm causes a period of acceleration in the firearm (velocity is changed) in the opposite direction of the mass. This changed velocity continues for as long or short a time as the small mass continues the velocity change caused by the period of force on the transfer device. If the time is short, the short period of velocity change causes a small position/attitude change in the firearm. If the time period of velocity change is longer, a larger position/attitude change is caused for the same period of force as was caused by the short period of velocity change. After a period of velocity change, the mass can be halted in its motion in the transfer device as it has a limit to its travel or position change. The velocity change only occurs while the mass is in motion. As it has a limited range of motion, the motion of the mass can either be stopped by another period of force in the opposite direction or the mass can be caused to run into the physical end of its travel. However the mass ceases travel, the end of the motion of the mass will stop the velocity change in the firearm. If the force is continued after the mass reaches the end of its range of travel, the force on the mass and the force on the transfer device may continue indefinitely, but the firearm will not further change velocity, position or attitude as the two forces locally cancel each other and affect no further motion in the mass or the firearm.

In an example of a firearm starting in a motionless state, if the movable mass weighs 0.1 lbs. and is displaced 10 inches away from the firearm and the firearm weighs 10 lbs., the reactionary motion, or the momentum transferred to the firearm, would cause the firearm to move approximately 0.1 inches away from the starting position of the mass. Alternatively, if the movable mass weighs 0.1 lbs. and is displaced 10 inches towards the firearm and the firearm weighs 10 lbs. the reactionary motion transferred to the firearm would cause the firearm to move approximately 0.1 inches in the direction of the starting position of the mass. Many combinations of magnitudes of force, length of times of applied force, and velocities of the mass can be used to cause these motions. These differences will only affect how fast the motions of the mass and firearm change position, not the distances moved or the limits to how much motion can be created.

In the embodiment shown, the momentum transfer system 52 comprises first and second linear motion applicators 60A and 60B in the form of, and that are configured to function as, the individual legs of a bipod structure. In addition to its other benefits, the bipod structure may be operable to function as a normal bipod otherwise would with the firearm. With appropriate compliances that can be engaged or locked, the firearm may be used with or without the aim assist system. In one aspect, this allows the bipod to be used as a simple support. In another aspect, the shooter can utilize the aim assist system during normal use of the bipod. This can be done, for example, with the shooter lying prone and the aim assist improving the accuracy of the shooter's fire. First and second linear motion applicators 60A and 60B are physically coupled to the firearm, specifically about the muzzle of the firearm, and are each operable to cause a bi-directional linear motion within the firearm along different axes. In other words, the first and second linear motion applicators 60A and 60B are each operable to provide a motion to their respective moveable masses and thereby provide a bi-directional reactionary motion or momentum transfer to the firearm.

It should be appreciated that the second linear motion applicator 60B is coupled to the firearm in an offset position from the first linear motion applicator 60A, and relative to the muzzle of the firearm, such that the second linear motion applicator is operable to apply a bi-directional linear motion to the firearm in a direction different from the motion applied by the first linear motion applicator. For example, a reactionary motion applied to the firearm by the first linear motion applicator 60A may be along the longitudinal axis of the first linear motion applicator 60A, and a reactionary motion applied to the firearm by the second linear motion applicator 60B may be along its longitudinal axis. As these axes are offset from one another as a result of the radially offset position of each about the firearm, and particularly about the longitudinal axis of the muzzle of the firearm, the resultant reactionary motions applied to the firearm will be in different directions.

As will be appreciated by those skilled in the art, application of reactionary motions to the firearm in different directions, for different durations, and also at selective times (e.g., at the same time, at alternating intervals, at sequential intervals, etc.) can cause the firearm to move at different magnitudes and in different directions to cause the actual aiming vector to also likewise move. Thus, depending upon the position of the optimal aiming vector and the actual aiming vector when there is an aim deviation, the aim assist system can be activated to apply one or more motions to the moveable weights thereby providing reactionary motions to the firearm in order to correct the aim deviation.

More specifically, each linear motion applicator 60A and 60B can comprise a weight or a mass which can be moved axially in a bi-directional manner along the respective lengths of the linear motion applicators when acted upon by a force and caused to be accelerated and moved. Thus, each linear motion applicator can create various respective linear reactionary motions which act in a direction coaxial with each respective bipod leg. Exemplary specific systems and methods of generating these motions will be discussed in more detail below.

By providing a momentum transfer system 52 having a first linear motion applicator 60A and a second linear motion applicator 60B, such linear motion applicators being oriented at different angles from one another relative to the muzzle of a firearm, dynamic forces, displacements and attitude changes can be generated which act upon the firearm, which motions can induce both linear and angular/attitude motions or movements within the firearm to alter the actual aiming vector for purposes of correcting the aim deviation.

There is a well understood principle that a vector can be broken down into an X-component and a Y-component, or alternatively a point in a plane can be described by an X-component and a Y-component, or further, any point in a 2-dimensional plane can be reached from another point in the plane by the adding of two non-parallel vectors by changing their magnitudes. Similar to these principles, having first and second linear motion applicators 60A and 60B oriented at different angles with respect to one another, as described herein, provides the ability to apply a motion to the firearm 20 to move the firearm and manipulate the actual aiming vector in any desired direction within an x-y plane as seen within the viewfinder of the targeting system (the x dimension comprising movements in a parallel or horizontal direction relative to the horizon, and the y dimension comprising movements in a normal or vertical direction) and in any desired magnitude (within the limits of the system). By enabling the application of a momentum transfer operable to displace the firearm 20 in any given direction, the ability is achieved to push the muzzle of the firearm 20 such that the actual aiming vector can be manipulated in order to move the actual aiming vector of the firearm in a desired direction to align with the calculated optimal aiming vector.

Depending upon the manner in which the first and second linear motion applicators 60A and 60B are activated and depending on the manner of movement of the masses contained therein, resultant firearm movements can be achieved which track along a linear path in either of the x-y dimensions, or alternatively which track a curved or arced path within the x-y plane. As one example of actuating the aim assist system to cause the firearm to travel in a linear path (i.e., in a single dimensional direction), both of the first and second linear motion applicators 60A and 60B can be actuated at the same time, to displace their respective masses the same distance, and at the same rate. In this case, the resulting momentum transfer to the firearm would be to cause the firearm to travel a corresponding distance in the vertical direction (along the y-dimension) (assuming the actuators are positioned about the firearm at the same angle relative to the vertical axis (e.g., at 30, 45, or 60 degrees)). As an example of actuating the aim assist system to cause the firearm to travel a multi-dimensional arcuate or arc-like path (e.g., a path in both the x and y dimensions), the first and second linear motion applicators 60A and 60B can be actuated at the same time, to travel in the same direction, but at different rates and/or different distances. The cumulative effect of the first and second linear motion actuators being actuated differently induces the arcuate movement of the firearm. As those skilled in the art will recognize, numerous different single or multi-dimensional paths can be induced within the firearm by varying the manner in which the various masses within the first and second linear motion applicators are actuated.

In order to calculate an appropriate motion to be generated by each of the first and second linear motion applicators 60A and 60B for aligning the actual aiming vector with the calculated optimal aiming vector and correcting the aim deviation, the aim assist system 50 can receive an aim deviation (or information pertaining thereto) as calculated by the targeting system 30, which reflects an angular deviation between the actual aiming vector and the optimal aiming vector. In other words, the aim assist system 50, with the help of processing unit 54, can determine a vector which represents the deviation between where the firearm 20 is actually pointing and where it needs to be pointed. The processing unit 54 can then calculate a direction, a magnitude, and duration of the motion to be induced within the firearm to correct the aim deviation. This calculation can be based on at least one of the current actual aiming vector, the aim deviation, any additional targeting information, tracer shot information, and one or more correction factors. The momentum transfer system 52 can then be actuated and the masses moved in each of the respective linear motion applicators 60A and 60B in order to generate the determined dimensional motion to appropriately correct the aim deviation.

Factors which can affect the one or more dimensional motions induced within the firearm can include the location of the masses with respect to each other and the firearm, the mass and mass distribution of the firearm, the mass of the masses, the amount of available travel, the amount of resistance typically applied by the user in various directions and points on the firearm, etc. This information can be obtained by providing various sensors within the firearm and the aim assist system 50, which sensors can gather the needed information and provide this to the processing unit 54. The processing unit 54 can also have a closed loop control which actively compensates for tremors and or variations in the force applied by the shooter 2 holding the firearm 20, such that the firearm 20 can be allowed to maintain an alignment between the actual aiming vector and the optimal aiming vector in the presence of such irregularities. Indeed, the aim assist system can be operated in a continuous manner to match a motion of the target and to cancel out undesirable movements by the shooter.

It should be appreciated that different characteristics of motion of the rifle's muzzle may be achieved by varying the movement characteristics of the various masses within their respective motion applicators. For example, the masses may be provided with varying rates of acceleration, or varying speeds, in order to vary the momentum transfer characteristics and the resulting motion within the firearm's muzzle. Additionally, the way the firearm behaves when the optimal aiming vector and the actual aiming vector become aligned may be changed by changing the way the respective masses are decelerated or otherwise stopped after being initially acted upon by their respective actuators. For example, the masses may be quickly decelerated to a stop when a desired displacement of both the masses and the firearm has been achieved. Alternatively, the masses may be caused to move the firearm, and therefore the actual aiming vector, through the optimal aiming vector, wherein the system is configured to automatically fire the firearm at the desired time.

Figure 4:
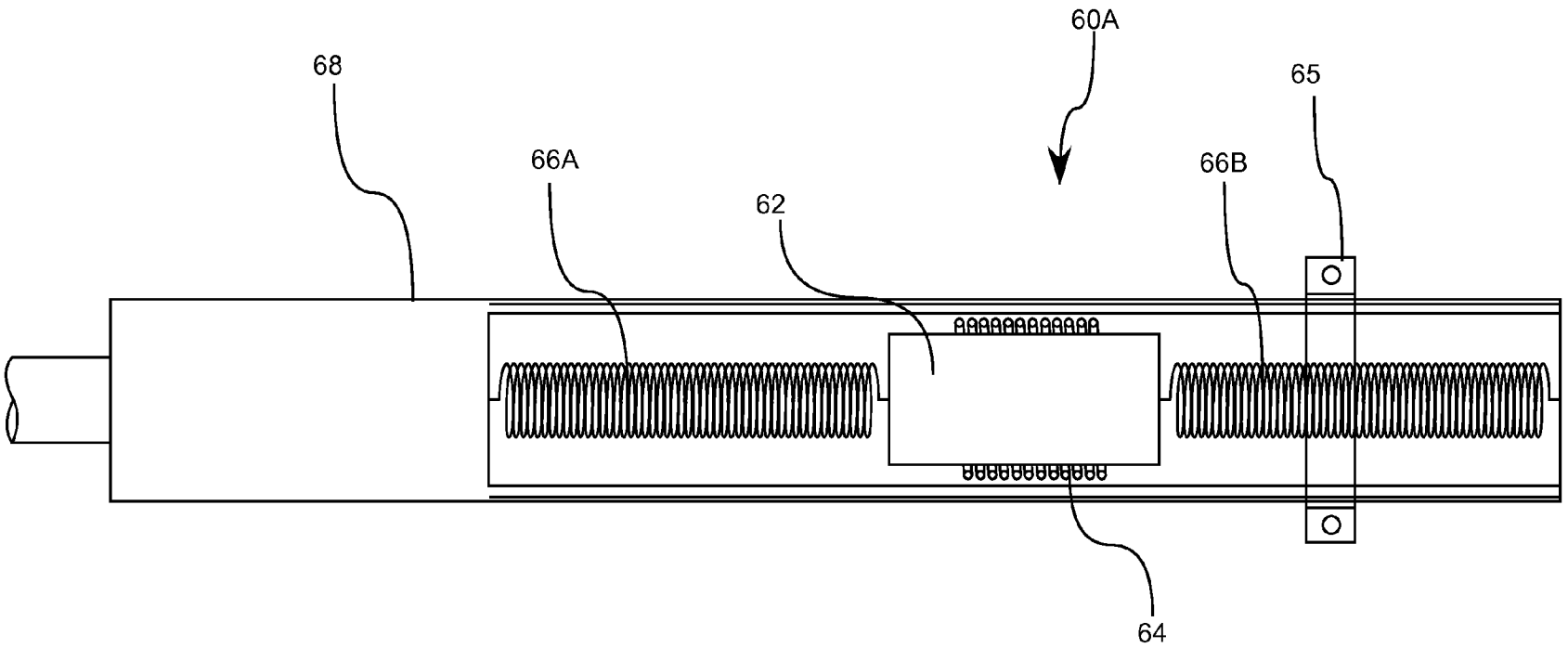
FIG. 4 depicts a partial cross-sectional view of a bipod leg component of an aim assist system as part of the shooting system of FIG. 1.

With reference to FIG. 4, illustrated is the first linear motion applicator 60A of the momentum transfer system 52 discussed above, in accordance with one exemplary embodiment. It is noted herein that although the following discussion is directed toward the first linear motion applicator 60A of the momentum transfer system 52, all features and functions discussed with respect to this linear motion applicator can be similarly applied to the second linear motion applicator 60B of the momentum transfer system 52.

The first linear motion applicator 60A of the momentum transfer system 52 can comprise an outer body or sleeve 68, which can comprise the outer tube of a bipod leg. The outer body 68 is one example of a transfer device that is coupled or mounted to the firearm, can house a motor, such as an electromagnet type motor 64 operable to facilitate or induce movement of a mass 62 as movably supported within the outer sleeve 68. The mass 62 can be provided in the form of a permanent magnet operable with a single coil of the electromagnet, wherein the mass moves in response to current being passed through the coils. However, in another aspect, the mass can comprise a magnetized or non-magnetized ferromagnetic material that responds to the magnetic field formed by passing a current through multiple coils of the electromagnet 64, each coil having the capability of separate control.

Optionally in some embodiments, the linear motion applicator can be configured so that the mass 62 may be caused to have a resting position when the aim assist is inactive. In one exemplary arrangement, a pair of springs 66A and 66B can be provided to affix the mass 62 to opposing axial ends of the sleeve 68. The springs 66A and 66B can be configured to center the mass 62 within the sleeve 68 when the aim assist system is inactive. Centering the mass 62 within the sleeve 68 allows for a full range of motion of the mass 62 in either direction upon activation of the aim assist system. Other methods of providing a resting position, such as using counter weights and air pressure bladders, will be apparent to those skilled in the art.

It will be appreciated that the electromagnet 64 can be configured in a number of different ways to achieve different force outputs. For example, electromagnetic coils making up the electromagnet 64 can extend partially or along the entire length of the sleeve 68. In addition, multiple electromagnets or commutated electromagnets can be employed in a linear motion applicator.

Additionally, the linear motion applicator 60A can further comprise a mechanism employing a series of pins 65 which can lock the mass 62 in a particular location within the sleeve 68. This can be beneficial to prevent unwanted movement within the aim assist system, such as when the firearm is not being used (e.g., during transport). It should be appreciated that only a single pin 65 is shown. However, any number of such pins can be provided as would be recognized by one of ordinary skill in the art. Moreover, it is contemplated that other types of devices or systems may be used to lock the mass 62 in a particular position, such as clamps, screws or other fasteners, as well as other types of devices or systems.

Additionally, alternative mechanisms are contemplated which can provide motion to a mass to cause a momentum transfer to the firearm through a transfer device coupled thereto, and which may also include position sensors to ensure proper centering in between uses or to provide information such as when the mass is nearing motion limits, mass velocity, and/or magnet position for commutated systems. Such systems may include screw type systems wherein rotation of a threaded shaft (e.g., via a motor) which passes through the weight causes the weight to move about the threaded shaft, such as to travel the linear distance of a housing. Pneumatic, piezoelectric, hydraulic, or other electronic systems may similarly be employed as will be recognized by those of ordinary skill in the art.

The aim assist system functions by displacing the mass 62 in order to induce a pushing or pulling motion on the muzzle of the firearm as the mass 62 is displaced along the length of the sleeve 68. This pushing or pulling motion is provided by energizing, i.e. passing a current through, the electromagnet 64 which will subject the mass 62 to an electromagnetic field. The electromagnetic field will then cause the mass 62 to translate along the length of the sleeve 68. By changing the current direction through the electromagnet 64, the mass 62 can be caused to move in an opposite direction. As such, varying the amount and direction of current to the electromagnet, the mass 62 can be caused to move bi-directionally along the axial length of the sleeve 68. As the mass 62 moves, it exerts a reactionary motion on the coils, which are coupled to the sleeve 68 in some fashion. As the sleeve 68 is coupled to the firearm, a reactionary motion is applied to or induced within the firearm to cause it to move.

With reference to FIGS. 1-4, and for purposes of explanation, it should be appreciated that the reactionary motion generated by the moving mass 62 will either push or pull the firearm 20 depending on the direction of travel of the mass 62. For example, if the mass 62 is moved directionally away from the firearm 20, the reactionary motion will push the firearm 20 in a direction away from the linear motion applicator (e.g., the first linear actuator 60A). If the mass 62 is moved toward the firearm 20, the reactionary motion will tend to pull the firearm 20 in a direction towards the linear motion applicator 60A, thus having a pulling effect on the firearm 20.

Providing at least a similar second linear motion applicator 60B allows for an additional linear motion to be applied to the muzzle of the firearm 20. The combination of these motions from their respective components can then be combined in order to produce a multi-dimensional reactionary motion, as discussed above, to correct the aim deviation and align the actual aiming vector with the calculated optimal aiming vector. Once the actual aiming vector and the optimal aiming vector are aligned, the shooter can fire the firearm and have the highest possible likelihood of actually hitting the target.

Activation of the aim assist system can further comprise deactivating the motion applicators to discontinue the application of the motion(s) acting on, or to move, the rifle. This is applicable to any of the example embodiments discussed herein, or further contemplated. For instance, in the example of the electromagnet and the moving mass, deactivating these can mean deactivating the electromagnet either by removing the current, by reducing the current over time, or by reversing the current. It should be appreciated that once movement of the mass is induced, the mass will tend to continue to move until acted upon by a secondary decelerating or arresting force. As the mass continues to move, so too will the muzzle of the firearm, albeit in an opposing direction. Indeed, the muzzle of the firearm will tend to want to continue to swing until an arresting/decelerating force is applied to the mass, and thereby the firearm. Depending on the desired characteristics of motion, i.e. whether the system is configured to swing the actual aiming vector through the calculated optimal aiming vector or whether the system is configured to locate the actual aiming vector on the optimal aiming vector, the arresting/decelerating force may be applied before, at the time, or after the two vectors are aligned. In one aspect, the masses can be decelerated over time. For example, the decelerating force can be applied progressively to the masses as the two vectors are nearing alignment. In this case, before exact alignment is achieved, the masses can be caused to decelerate over a given period of time, thus causing the rifle to gradually settle into position with the vectors aligned. In another aspect, the masses can be arrested nearly instantly. In this case, for example, movement of the masses can be suddenly or quickly arrested at the precise time of alignment of the vectors, at which time the rifle can be fired. In still another aspect, the masses can be decelerated after the alignment of the two vectors. In this case, the actual aiming point will tend to "swing through" the optimal aiming vector, and the rifle caused to fire at the point of alignment.

Figure 5:
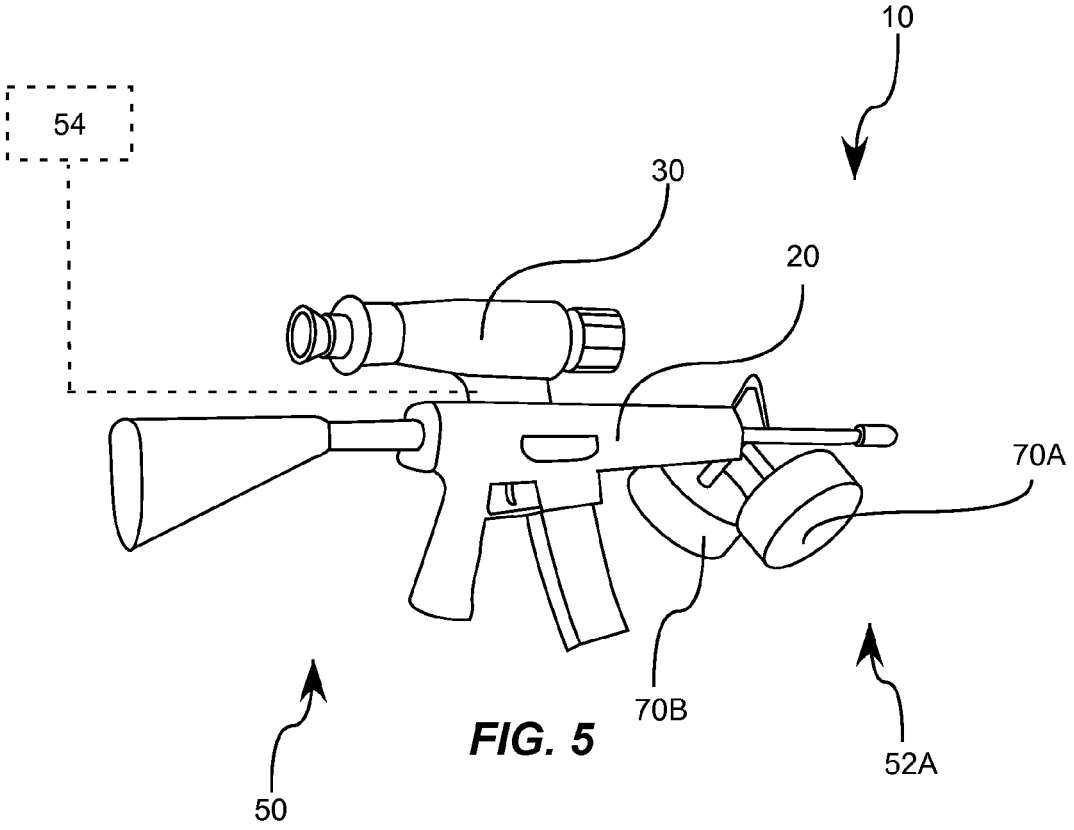
FIG. 5 depicts a side isometric view of a shooting system in accordance with an alternative embodiment.
Figure 6:
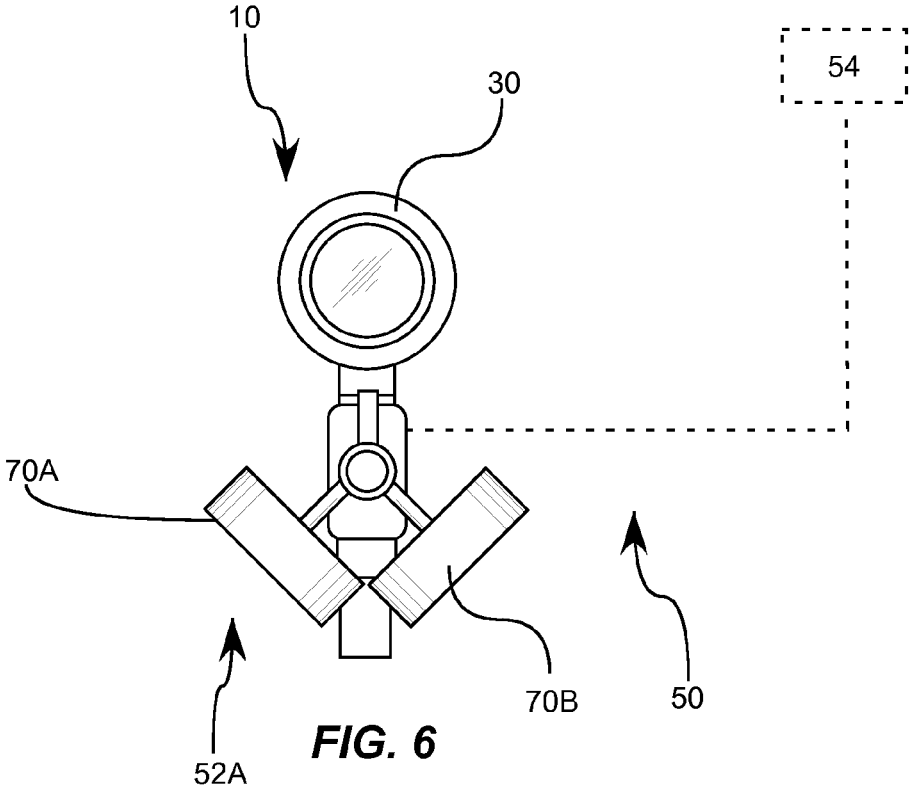
FIG. 6 illustrates a front view of the shooting system of FIG. 5.

FIGS. 5-6 illustrate an alternative embodiment of a shooting system comprising an aim assist system 50A having a momentum transfer system 52A that utilizes angular inertial motion applicators 70A and 70B. Angular inertial motion applicators 70A and 70 B can be affixed to the firearm 20 in a similar manner as the linear motion applicators discussed above with reference to FIGS. 1-4. The aim assist system 50A and the momentum transfer system 52A can also be in communication with targeting system 30A in a manner similar to the embodiments discussed above with reference to FIGS. 1-4.

Figure 7A:
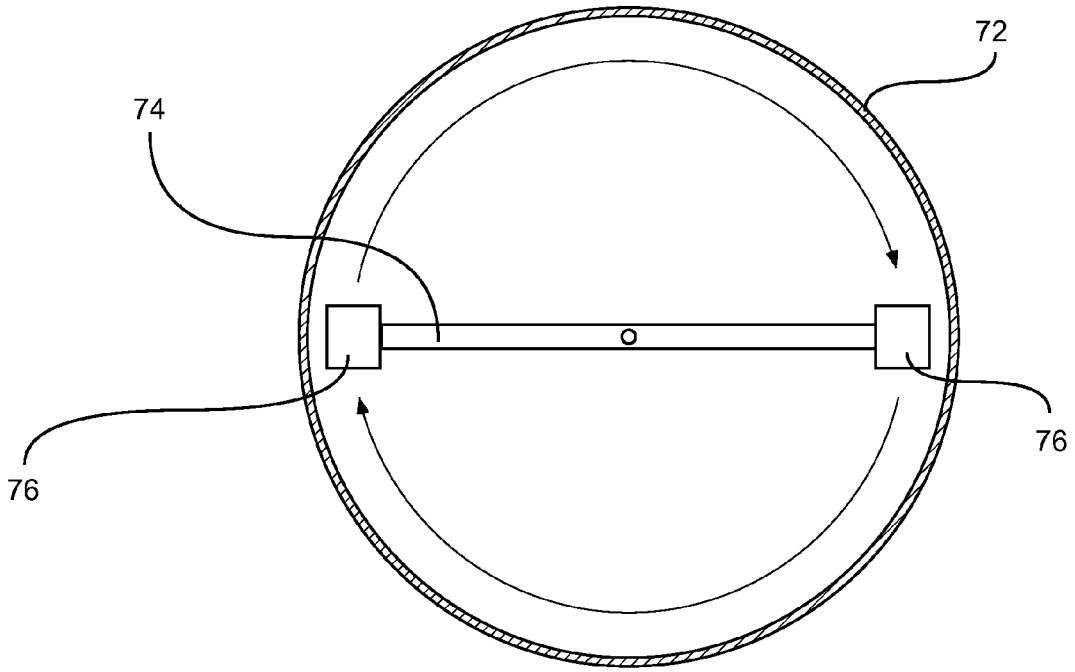
FIGS. 7A-B illustrate cross-sectional views of various implementations of inertial mechanisms for use within the shooting system of FIG. 5.
Figure 7B:
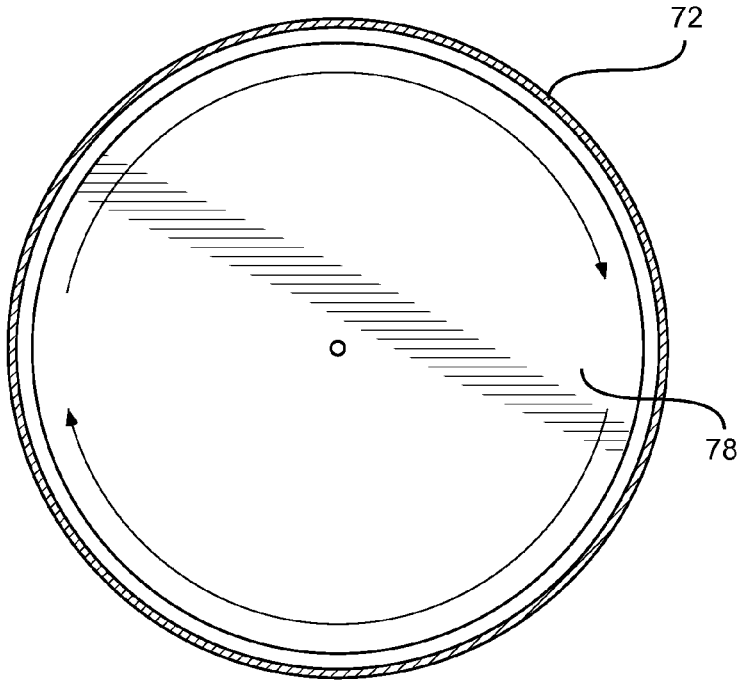

FIGS. 7A-B show an end cross-sectional view of inertial motion applicator 70A (with inertial motion applicator 70B being similarly configured). The inertial motion applicator 70A can comprise a hollow drum 72 which contains a moveable mass configured to be accelerated in a spinning manner in order to create a torque, and thereby a reactionary motion within the firearm. The mass can be moved or spun in a variety of ways, such as at different rates, in different directions, etc. FIG. 7A illustrates how an inertial mass can be provided in the form of a bar 74 having weights 76 located at opposing ends, wherein the bar 74 and associated weights 76 are spun about their center of mass. FIG. 7B shows an alternative embodiment in the form of a solid disc 78 that can be employed to provide a similar effect. Still other inertial motion applicators can comprise different configurations, such as a mass configured like a wheel having a hub, spokes and an outer mass located at an outer radius limit, the spokes connecting the outer mass to the center of rotation or hub.

The inertial motion applicators 70A and 70B function similarly as the linear motion applicators, in that the movement of one or more masses relative to the firearm within structures coupled to the firearm will cause a reactionary motion within the firearm 20, which can be used to manipulate the actual aiming vector of the firearm 20. Again, the first and second inertial motion applicators 70A and 70B can be actuated in a selective manner to provide or output different types of dimensional motions (e.g., one or multi-dimensional reactionary motions). Such output can be effectuated by controlling the manner in which the inertial applicators are actuated and stopped. Unlike the earlier described linear motion applicators, the inertial motion applicators 70A and 70B can be rotated indefinitely in either direction.

As discussed above the inertial motion applicators 70A and 70B function by rotating a weight or mass to provide an inertial reactionary motion, rather than displacing the mass linearly to provide a linear reactionary motion as discussed with respect to linear motion applicators. It should be appreciated that, one of ordinary skill in the art will recognize how the inertial reactionary motions can be used in place of the linear reactionary motions in order to manipulate the position of the firearm muzzle.

Figure 8:
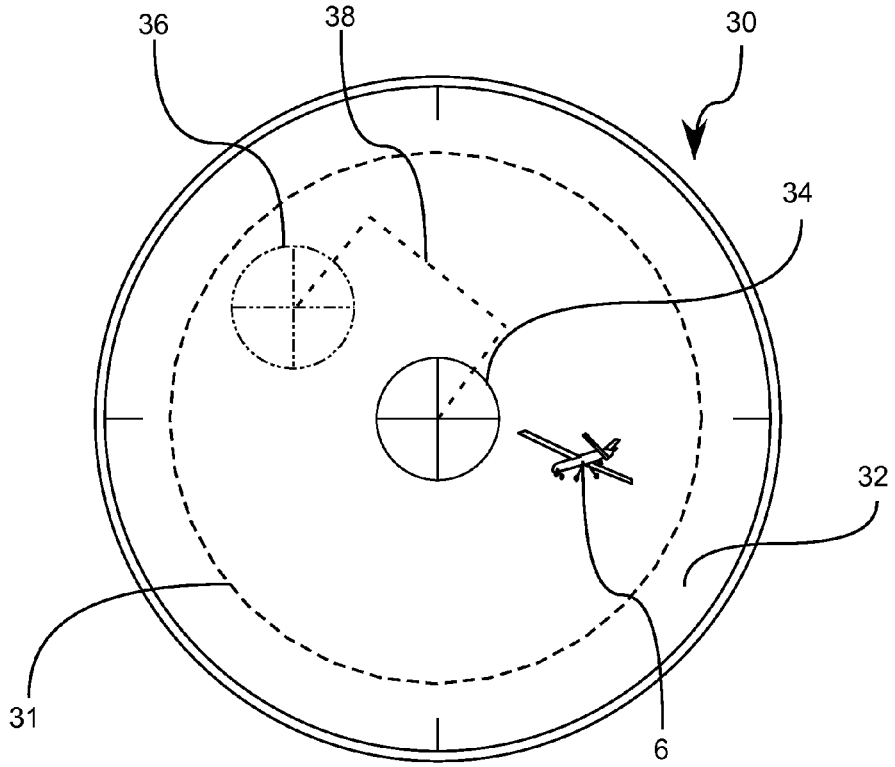
FIG. 8 illustrates a graphical representation of a view through a viewfinder of a targeting system as part of a shooting system.
Figure 9:
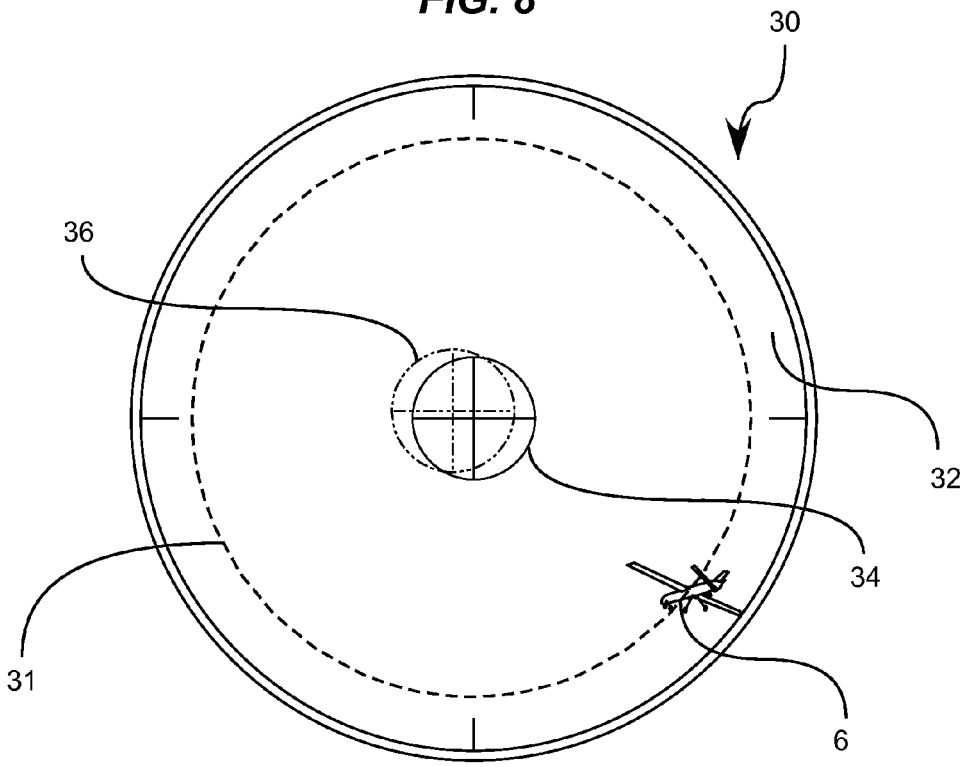
FIG. 9 illustrates an additional graphical representation of a view through the viewfinder of FIG. 8, which illustrates some of the functionality of the systems of the shooting system.

With reference to FIGS. 8-9 shown is an exemplary view from the users view with the targeting system 30, as shown in FIGS. 1-7. As discussed above, the targeting system 30 is provided with a plurality of sensors which provide information regarding the environment that is relevant in making ballistic calculations. As discussed above, these sensors can include a variety of different types, such as those that sense wind, temperature, angle, tilt, altitude, barometric pressure, etc. In addition to the environmental sensors, the targeting system can include a rangefinder, and an infrared camera.

Using the various sensors coupled with the rangefinder, the targeting system 30 can determine movement characteristics of an intended target. The shooter can utilize the targeting system to locate an intended target. The shooter can then provide some sort of indication or marking which designates a particular item within the users system view as a target. Using the rangefinder and various sensors, motion characteristics about the target can be collected and provided to a processor, which can calculate or otherwise make a calculated approximation of the flight trajectory of the target. In this manner a projected flight path of the target can be estimated by the targeting system 30.

The targeting system 30 can also calculate the range to the target and the time a bullet fired from the firearm would take to reach the target at that given range. Upon determining this, the targeting system 30 can calculate a very close approximate trajectory for such a bullet. This estimated trajectory can be calculated based on known ballistic techniques in order to generate an estimated ballistic arc based on the environmental conditions being received by the sensors as well as other factors, as discussed above, such as powder-load, caliber, and other known firearm data. These ballistics can be calculated using techniques such as those described in "Modern Exterior Ballistics" written by Robert L. McCoy published by Schiffer Publishing Ltd in March 2012, which reference is incorporated by reference herein in its entirety.

The processor upon determining the trajectory of the bullet and the projected flight path of the target can calculate and determine an optimal aiming vector, wherein a bullet fired in such a vector will have the highest chance of hitting the target. Or in other words, the optimal aiming vector describes a vector which, if a bullet were to be fired in such a direction, the trajectory of the bullet would likely intercept the projected flight path of the target at the precise time the target is at that point.

The targeting system 30 can be configured to display or otherwise indicate the optimal aiming point 36 within the field of view of the targeting system 30 by providing some type of indicator (shown as crosshairs). The optimal aiming point corresponds to the location where the firearm should actually be pointed in order to be aligned with the optimal aiming vector. The actual aiming point 34 can also be indicated in the system view of the targeting system 30. The targeting system 30 then calculates the discrepancy between the actual aiming point 34 and the optimal aiming point 36, which has been discussed herein as the aim deviation. The aim deviation relates to the angular difference between the actual aiming vector and the optimal aiming vector.

A zone of correction 31 may be provided within the targeting system 30, which zone of correction 31 defines the zone in which the aim assist system can be activated to achieve correction of the aim deviation, or in other words how far the system can move the actual aiming point. As such, the actual aiming point is not outside of this zone. If the optimal aiming point 36 is outside of this established zone of correction 31, the aim assist feature may be prevented from being actuated. It is noted that this inactive state can be utilized to reset the momentum transfer system (e.g., center the masses in their range of travel to prepare for use or being activated). Another way of stating this is that the aim assist system cannot correct all the aim deviation until the aim deviation is inside the area defined by the zone of correction 31. Once the aim deviation is brought within the predetermined zone of correction 31, the aim deviation is then relayed to the aim assist system, as described above, and the aim assist system activated to manipulate the firearm in order to correct for the aim deviation. While the "aim" is centered in the optical system (boresighted) the "impact point" can be moved outside of the field of view if narrow enough. At long enough ranges, the trajectory drops a very large amount and high side winds can push bullets a large distance away from the boresight line. After the range to the target of interest has been determined, the actual aiming point can be determined and displayed and the zone of correction can be displayed around that.

The predetermined zone of correction 31 can be a function of the limiting factors of the aim assist system. For example, the physical constraints of the momentum transfer system can function to limit the maximum aim deviation that can be corrected. Indeed, in the case of linear motion applicators, the weights can only travel so far. Thus, in the event that the actual aiming vector is too far from the optimal aiming vector, the limits of the momentum transfer system will be reached before a complete correction of the aim deviation can be made. As a result, it is preferable that the targeting system and aim assist system rely on the shooter to bring the optimal aiming vector and the actual aiming vector within the predetermined zone of correction prior to activating the aim assist system. Again, the aim assist system can provide the shooter with information pertaining to a direction in which to move the firearm to assist the shooter in getting the aim deviation to be within the zone of correction 31, as well as information pertaining to how the shooter can make additional movements to keep the target in the zone of correction.

The reactionary motions provided by the aim assist system can be calculated, at least in part, upon various correction factors. Correction factors can include environmental factors such as elevation, angular position, wind speed, etc., but can also include characteristics of the firearm, such as weight and center of mass. Additionally, correction factors can include iterative information gained regarding the user's tendency to tightly or loosely grip or hold the weapon. In one exemplary aspect, the system can be configured to sense the image movement at the instant of firing (such as that caused by repeated flinching) and, if repetitive, can add compensation on subsequent shots. These correction factors can be changed iteratively for subsequent shots to improve the response of the aim assist system over time.

Once the aim deviation is corrected, the targeting system 30 can be configured to indicate to the shooter that the firearm can be fired. The targeting system 30 can further be configured to fire automatically when the aim deviation is corrected. This indication can be provided in any number of different ways, as will be appreciated by one of ordinary skill in the art, such as by having one of the indicators of the actual aiming point 34 turn from red to green. Essentially, once the aim deviation is corrected, the firearm can be fired.

In some embodiments, the targeting system 30 can be equipped with one or more imaging sensors (e.g., visible, infrared, etc.), and the shooting system equipped with tracer bullets viewable in the corresponding spectrum, wherein a tracer shot can be fired to provide an additional correction factor to be used by the targeting system in determining the aim deviation. As will be readily appreciated by one of ordinary skill in the art, an approximated trajectory can be calculated for the environmental conditions at the location of the shooter and the firearm. However, as is well known, certain environmental conditions can change throughout the distance between the shooter and the target. In particular, wind speed can differ significantly at various points along a ballistic arc. In order to overcome such limitations in the ballistic arc calculations, the tracer shot can be fired and the imaging sensor (e.g., camera) operated to image and track the bullet as the bullet travels through its ballistic arc. Simultaneously the targeting system can continue to track the target. Thus, the targeting system, by imaging the tracer bullet as well as simultaneously maintaining range and motion of the target, can determine the time of closest approach of the bullet to the target, should the bullet happen to miss on the first shot. This information can then be used as an additional correction factor to improve the accuracy of a subsequent shot.

With respect to determining the time of closest approach, in one example, ballistics calculations can take the inputs (for a given firearm and ammunition type) of a firearm's muzzle velocity, bullet mass, and ballistic coefficient and output a drop from the barrel axis at any given range. Bullet velocity may also be provided for each range in order to show bullet energy at a target at any range. These ballistics equations can provide the velocity for all ranges from the firearm up to the farthest ranges. With this information known, the amount of time after firing at any range can be calculated. As the range is measured with a rangefinder within the targeting system (e.g., a laser), it can be said that t milliseconds after firing the bullet will be at the same range as the target and at a distance d from the firearm. At t milliseconds after firing, the target and the bullet will be at their closest approach to one another.

The point of closest approach of the bullet to the target can define a distance missed. The miss distance will herein be referred to as a miss vector, consisting of the miss distance and the miss direction. The targeting system, using the miss vector obtained from the tracer shot, can then calculate an updated optimal aiming point using the miss vector as an additional variable describing the sum of uncertainties and errors in other information in order to calculate and provide an updated optimal aiming vector and aim deviation.

The updated optimal aiming vector can be calculated based on all the continuously updated environmental factors, as discussed above, in addition to the determined miss vector. In this manner, as subsequent shots are fired, the targeting system can recalculate the miss vector after each shot, which miss vectors can be used to provide updated optimal aiming vector calculations until the miss vector is eliminated, or in other words until shots begin hitting the target. In this way the miss vector can be provided on a closed loop back to the processor as error feedback so as to iteratively eliminate the error and improve accuracy, as well as compensate for inaccuracies in the input variables and changing conditions.

FIG. 8 shows how the actual aiming point 34 is related to the optimal aiming point 36 upon first obtaining a target 6 within the telescopic sight 32 of the targeting system 30 wherein a large aim deviation 38 is present. On the other hand, FIG. 9 shows how the aim deviation is substantially corrected with the aim assist system activated and being utilized to move the firearm up and to the left. This view shows how the actual aiming point 34 and the optimal aiming point 36 are almost aligned as the firearm is being pushed upward and to the left. When these are totally aligned the targeting system can signal to the shooter a ready for fire state, which state has the highest chance of hitting the target 6. An alternative method of displaying this is to display one cross hair in a position such that when the firearm is optimally pointed, the target and the cross hairs are coincident.

The present disclosure further provides a method for improving accuracy of a shot to a target as fired from a handheld firearm in accordance with an exemplary embodiment. The method can comprise identifying a target; obtaining targeting information pertaining to the target; identifying an actual aiming vector of the firearm; calculating an optimal aiming vector based on the targeting information; determining an aim deviation of the optimal aiming vector from the actual aiming vector; determining a motion of the firearm suitable to manipulate the actual aiming vector of the firearm to correct for the aim deviation; and activating an aim assist system supported by the firearm to induce the motion within the firearm, wherein activating the aim assist system further comprises activating a momentum transfer system.

Obtaining targeting information can comprise identifying apparent target motion and using system firearm motion sensors to separate target motion from firearm motion. Determining a motion of the firearm can comprise determining a direction and magnitude of motion to be induced within the firearm sufficient to eliminate the aim deviation based on the aim deviation, any applicable targeting information, and a plurality of correction factors. Activating an aim assist system may comprise moving one or more actuated masses within the momentum transfer system to cause a momentum transfer to the firearm.

The method may further comprise firing a tracer shot at the target; determining a miss vector based on the relative positions of the tracer and target at a time of closest approach of the tracer shot to the target; calculating an updated optimal aiming vector based on the movement characteristics of the target, environmental factors, and the miss vector; determining an updated aim deviation of the updated optimal aiming vector from the previous optimal aiming vector, now an updated actual aiming vector; determining a motion of the firearm suitable to manipulate the updated actual aiming vector to correct for the updated aim deviation; and activating the aim assist system a subsequent time to induce the motion within the firearm to correct for the updated aim deviation.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A shooting system, comprising:

a hand-held firearm;

a targeting system supported about the firearm, the targeting system operable with one or more sensors to obtain targeting information regarding a target, and to determine an optimal aiming vector of the firearm and an aim deviation of an actual aiming vector of the firearm from the optimal aiming vector based on the targeting information, the targeting information comprising tracer information obtained upon a user firing a tracer shot at the target, the tracer information comprising data representative of the relative positions of the tracer and target at a time of closest approach of the tracer shot to the target, wherein the optimal aiming vector comprises a miss vector based on the tracer information; and an aim assist system in communication with the targeting system to receive information corresponding to the aim deviation, the aim assist system comprising a momentum transfer system supported by the firearm and comprising an actuator having a mass moveable relative to the entire firearm and operable to induce a motion within the firearm, causing the entire firearm to move in a direction different than the directional movement of the mass, to manipulate the actual aiming vector of the firearm and to correct for the aim deviation.

2. The shooting system of claim 1, wherein the momentum transfer system is a contained or substantially closed system, and comprises:

a transfer device coupled to the firearm; and a mass moveable within the transfer device and relative to a the firearm, wherein the motion within the firearm is induced by movement of the mass to generate a proportional momentum transfer to the firearm through the transfer device.

3. The shooting system of claim 2, wherein the aim assist system determines a magnitude and direction of the motion based on at least the aim deviation and a plurality of correction factors.

4. The shooting system of claim 2, wherein the aim assist system further comprises:

a processing unit operable with the momentum transfer system, the processing unit determining a direction, a magnitude, and duration of the motion to be induced within the firearm based on at least one of the aim deviation, any additional targeting information, tracer shot information, and one or more correction factors, wherein the momentum transfer system is configured to induce the motion within the firearm as determined by the processing unit.

5. The shooting system of claim 4, wherein the momentum transfer system comprises:

a first inertial motion applicator coupled to the firearm, and operable to induce a motion within the firearm by rotating a first mass; and a second inertial motion applicator coupled to the firearm in a position offset from the first inertial motion applicator, the second inertial motion applicator being operable to induce a motion within the firearm by rotating a second mass, the first and second inertial motion applicators inducing motions within the firearm along different respective paths.

6. The shooting system of claim 1, wherein the targeting system determines an updated optimal aiming vector based on the miss vector.

7. The shooting system of claim 1, wherein the aim assist system is active when the aim deviation is within a predetermined zone of correction.

8. The shooting system of claim 1, wherein the momentum transfer system comprises;

a first linear motion applicator coupled to the firearm, and operable to induce a bi-directional linear motion within the firearm;

a second linear motion applicator coupled to the firearm and offset from the first linear motion applicator, the second linear motion applicator operable to induce a bi-directional linear motion within the firearm along an axis different from an axis of the motion as induced by the first linear motion applicator.

9. The shooting system of claim 8, wherein the first and second linear motion applicators each comprise:

an outer sleeve as a transfer device coupled to the firearm;

a mass moveable within the outer sleeve and relative to the firearm; and an electromagnet operable to cause the mass to selectively displace bi-directionally within the outer sleeve.

* * * * *